US007503624B2

(12) United States Patent
Hoffman et al.

(10) Patent No.: US 7,503,624 B2
(45) Date of Patent: Mar. 17, 2009

(54) PRESS-BACK STYLE RECLINING CHAIR WITH ACTUATING UNIT FOR MOVING BACKREST BETWEEN POSITIONS

(75) Inventors: D. Stephen Hoffman, High Point, NC (US); Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 11/755,335

(22) Filed: May 30, 2007

(65) Prior Publication Data

US 2008/0023992 A1 Jan. 31, 2008

Related U.S. Application Data

(60) Provisional application No. 60/819,863, filed on Jul. 11, 2006.

(51) Int. Cl.
*A47C 1/024* (2006.01)
*A47C 1/02* (2006.01)

(52) U.S. Cl. ..... 297/68; 297/69; 297/362.12; 297/362.14

(58) Field of Classification Search ..... 297/68, 297/69, 362.12, 362.14
See application file for complete search history.

(56) References Cited

U.S. PATENT DOCUMENTS 507,270 A 10/1893 Hirschfeld
2,526,623 A 10/1950 Maurer
2,714,922 A * 8/1955 McKibban et al. ..... 297/83
3,147,038 A * 9/1964 Barabas ..... 297/89
3,383,135 A * 5/1968 Posh ..... 297/362.12
3,622,202 A * 11/1971 Brown ..... 297/362.12 X
3,863,980 A * 2/1975 Ciner ..... 297/69
4,307,912 A * 12/1981 Watt et al. ..... 297/85
4,386,803 A * 6/1983 Gilderbloom ..... 297/84

(Continued)

FOREIGN PATENT DOCUMENTS

GB 2106777 A 4/1983

OTHER PUBLICATIONS

Lusch Brochure for "Relaxing Chairs" (10pp), "Sofa Beds" (10 pp) "Bed Fitting" (5 pp) and "Upholstery joints and accessories for furniture" (8 pp). (available before Apr. 7, 2006).

(Continued)

*Primary Examiner*—Rodney B. White
(74) *Attorney, Agent, or Firm*—Myers Bigel Sibley & Sajovec

(57) ABSTRACT

A press-back style reclining seating unit includes: a frame configured to rest on an underlying surface; a seat fixed to the frame, the seat being generally horizontally disposed; a generally upright backrest positioned above the rear portion of the seat; and a reclining mechanism that interconnects the frame and the backrest and controls the movement of the backrest relative to the frame between an upright position, in which the backrest is generally vertically disposed, and a fully reclined position, in which the backrest is more reclined relative to the underlying surface than in the upright position. The reclining mechanism includes an actuating unit that enables the backrest to move to and remain in any partially reclined position between the upright and fully reclined positions.

12 Claims, 3 Drawing Sheets

U.S. PATENT DOCUMENTS 4,674,794 A * 6/1987 Pine ..... 297/68 X
4,681,365 A * 7/1987 Pine ..... 297/68 X
4,682,815 A 7/1987 Steifensand
4,691,964 A * 9/1987 Morgan ..... 297/330
4,696,512 A * 9/1987 Burnett et al. ..... 297/68
4,722,566 A * 2/1988 Castellini ..... 297/68
4,813,743 A * 3/1989 Mizelle ..... 297/301.2
5,007,679 A * 4/1991 Mizelle ..... 297/68 X
5,086,769 A * 2/1992 Vianello et al. ..... 297/68 X
5,884,970 A * 3/1999 Howard ..... 297/362.14
5,931,535 A * 8/1999 Sweet ..... 297/68 X
6,491,342 B1 * 12/2002 Smith ..... 297/68
6,612,650 B1 * 9/2003 Ambrosio et al. ..... 297/68 X
6,948,777 B2 9/2005 Marshall et al.
7,083,235 B2 8/2006 Grimm et al.
7,188,904 B2 * 3/2007 Bruck et al. ..... 297/362.14
7,293,834 B2 * 11/2007 Riach et al. ..... 297/68 X
7,311,359 B2 * 12/2007 Smith ..... 297/68 X
2006/0082195 A1 * 4/2006 Jiang ..... 297/68

OTHER PUBLICATIONS

Stawett Brochure, pp. 3-93 (2001).

* cited by examiner

PRESS-BACK STYLE RECLINING CHAIR WITH ACTUATING UNIT FOR MOVING BACKREST BETWEEN POSITIONS

RELATED APPLICATION

This application claims priority from U.S. Provisional Patent Application No. 60/819,863, filed Jul. 11, 2006 and entitled Press-Back Reclining Chair with Linear Actuator, the disclosure of which is hereby incorporated herein in its entirety.

FIELD OF THE INVENTION

The present invention relates generally to seating units, and more particularly to seating units with reclining capability.

BACKGROUND OF THE INVENTION

Conventionally, a recliner chair will move from an upright position, in which the backrest is generally upright, to a reclined position, in which the backrest pivots to be less upright. The movement of the seating unit between the upright and reclined positions is typically controlled by a pair of synchronized reclining mechanisms that are attached to the seat, backrest and base of the chair.

One popular recliner chair is the so-called "press-back" chair, which has a backrest that is reclined through the application of force by the seated occupant to the chair's backrest. Because the occupant can recline the chair himself, there is no need for the press-back chair to have a handle or latch that causes the chair to recline. Some press-back chairs include an extendable footrest, while others lack such a footrest and are often used with a separate ottoman or footstool.

Given the popularity of press-back chairs, it may be desirable to provide press-back seating units with additional functionality.

SUMMARY OF THE INVENTION

As a first aspect, embodiments of the present invention are directed to a press-back style reclining seating unit. The seating unit comprises: a frame configured to rest on an underlying surface; a seat fixed to the frame, the seat being generally horizontally disposed; a generally upright backrest positioned above, the rear portion of the seat; and a reclining mechanism that interconnects the frame and the backrest and controls the movement of the backrest relative to the frame between an upright position, in which the backrest is generally vertically disposed, and a fully reclined position, in which the backrest is more reclined relative to the underlying surface than in the upright position. The reclining mechanism includes an actuating unit that enables the backrest to move to and remain in any partially reclined position between the upright and fully reclined positions.

As a second aspect, embodiments of the present invention are directed to a press-back style reclining seating unit, comprising: a frame configured to rest on an underlying surface; a seat fixed to the frame, the seat being generally horizontally disposed; a generally upright backrest positioned above the rear portion of the seat; and a reclining mechanism that interconnects the frame and the backrest and controls the movement of the backrest relative to the frame between an upright position, in which the backrest is generally vertically disposed, and a fully reclined position, in which the backrest is more reclined relative to the underlying surface than in the upright position. The reclining mechanism includes an electrically-powered linear actuator that enables the backrest to move between the upright and fully reclined positions.

As a third aspect, embodiments of the present invention are directed to a press-back style reclining seating unit, comprising: a frame configured to rest on an underlying surface; a seat fixed to the frame, the seat being generally horizontally disposed; a generally upright backrest positioned above the rear portion of the seat; and a reclining mechanism that interconnects the frame and the backrest and controls the movement of the backrest relative to the frame between an upright position, in which the backrest is generally vertically disposed, and a fully reclined position, in which the backrest is more reclined relative to the underlying surface than in the upright position. The reclining mechanism includes: a linear actuator that enables the backrest to move between the upright and filly reclined positions; two pivot links fixed to the backrest that pivot relative to the frame and to the linear actuator; a transversely-extending upper bridging member that spans the two pivot links; and a transversely-extending lower bridging member that spans the frame. The linear actuator is pivotally interconnected with each of the upper and lower bridging members.

DETAILED DESCRIPTION OF EMBODIMENTS OF THE INVENTION

Figure 1:
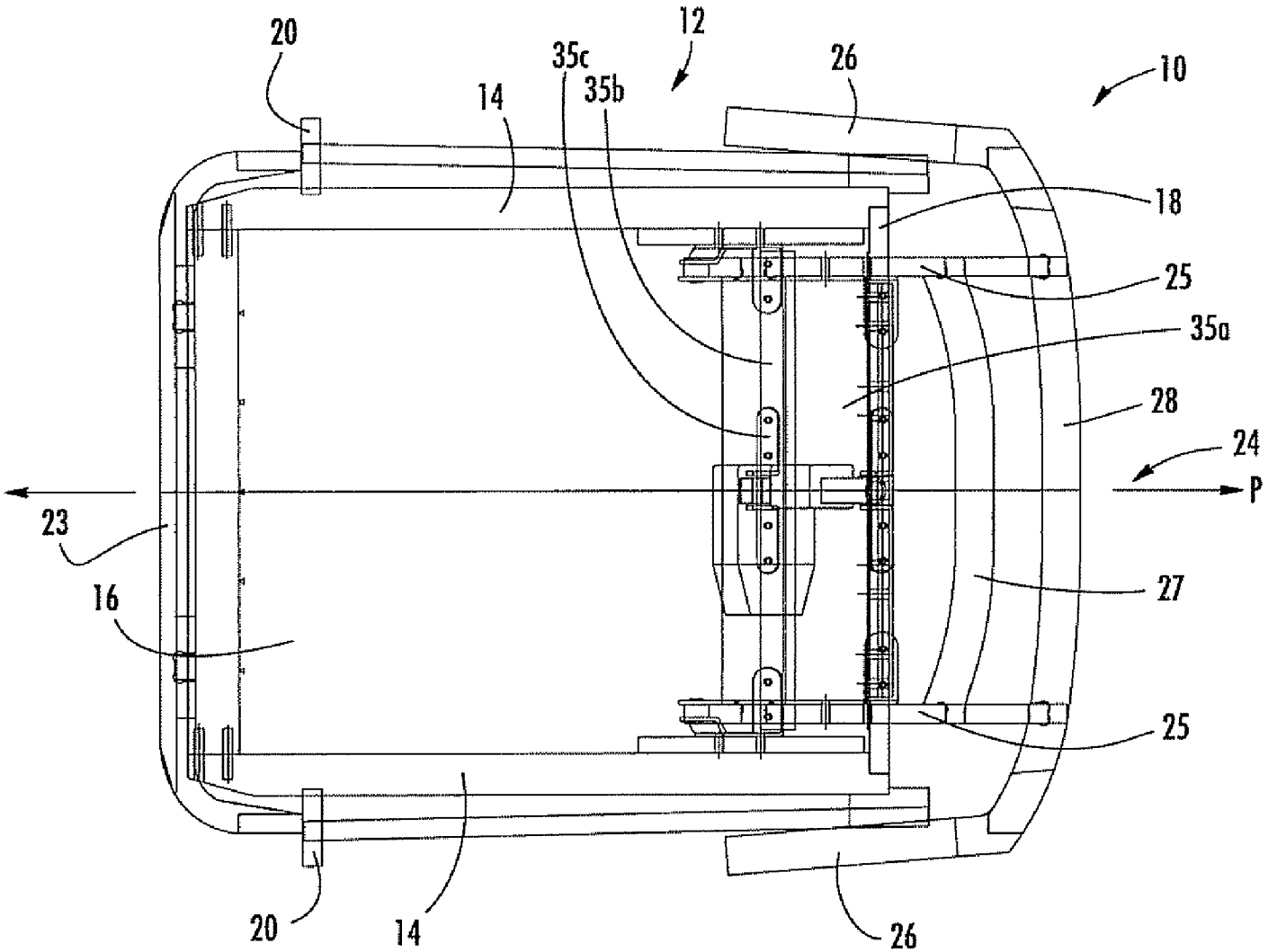
FIG. 1 is a top view of a press-back reclining chair with out upholstery and with the backrest shown in the upright position.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Figure 2:
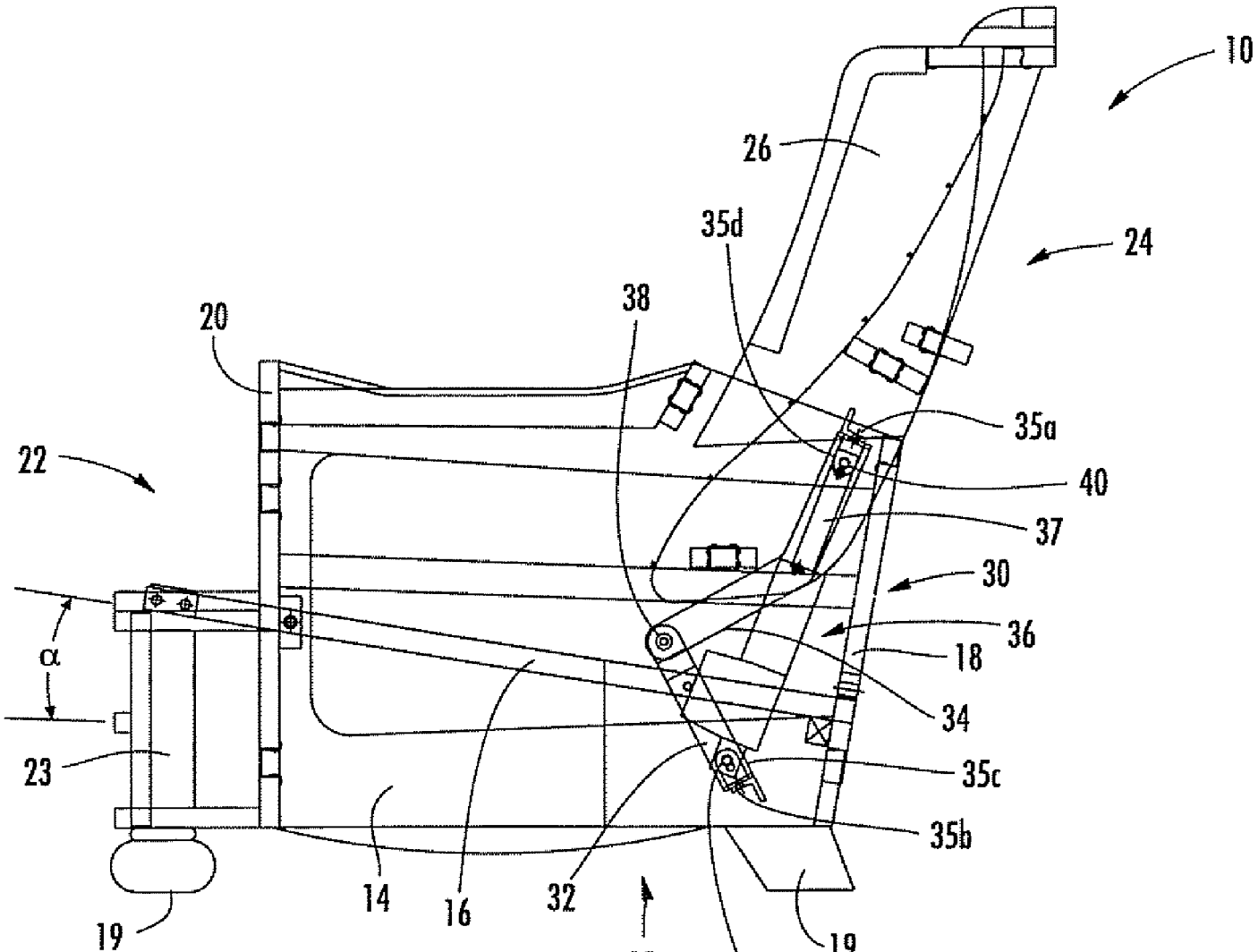
FIG. 2 is a cutaway side view of the chair of FIG. 1 with the backrest in the upright position.
Figure 3:
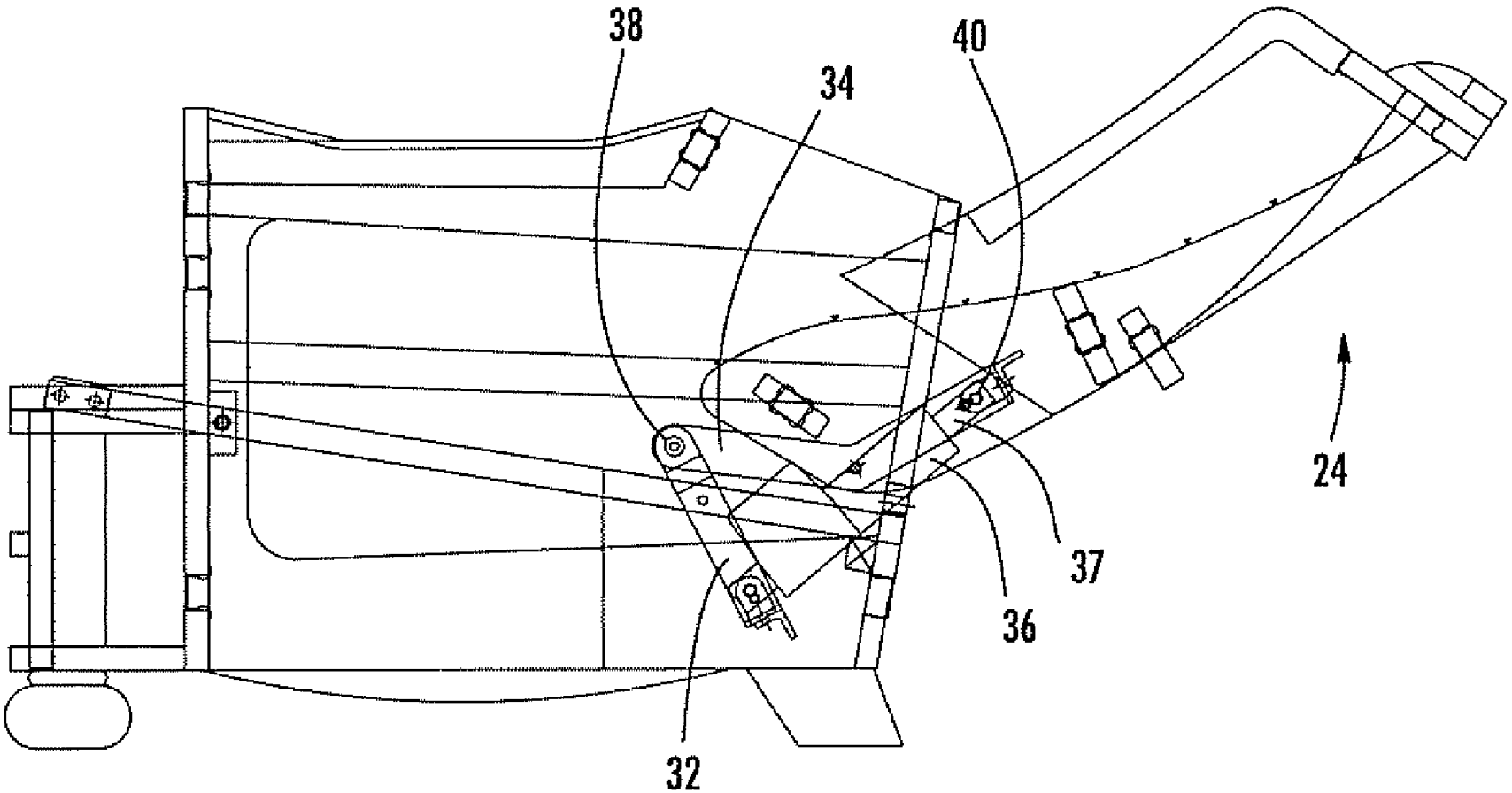
FIG. 3 is a cutaway side view of the seating unit in FIG. 1 in a reclined position.

Referring now to the drawings, a chair, designated broadly at 10, is illustrated in FIGS. 1-3. The chair 10 includes a frame 12, a seat 22, and a backrest 24. These components are described in greater detail below. For the sake of clarity, the chair 10 will be described initially with respect to FIG. 1, in which the backrest 24 is in its upright position and is generally vertically disposed. Description of the chair 10 in its reclined position will then follow. As used herein to describe the relative positions of components, the terms "lateral", "outward" and derivatives thereof indicate the directions defined by a vector beginning at and extending normal to a vertical plane P (shown in FIG. 1) that bisects the chair 10 normal to the seat 22 and the backrest 24. Conversely, the terms "inward", "inboard" and derivatives thereof indicate the direction opposite the "outward" direction. Together, the "inward" and "outward" directions comprise the "transverse" axis of the chair 10. The "rear" of the chair 10 is located at the tip of the backrest 24, and the "front" of the chair 10 is located at the end of the seat 22 farthest from the backrest 24. The "front" and "rear" directions comprise the "longitudinal" axis of the chair 10.

Referring now to FIGS. 1 and 2, the frame 12 includes side walls 14 (only one of which is shown in FIG. 2), a rear panel 18 that spans the rear ends of the side walls 14, and a seat panel 16 that extends between the inboard edges of the side walls 14. In the illustrated embodiment, the seat panel 16 is inclined from front to back; the incline angle $\alpha a$ is typically between about 0 and 10 degrees relative to the floor or other underlying surface. Arm panels 20 are attached to the front edges of the side panels 14. A seat support cage 23 spans the side walls 14 under a front portion of the seat panel 16. Feet 19 rest on the underlying surface and support the frame 12 from beneath.

Still referring to FIGS. 1 and 2, the backrest 24 includes inner side panels 25 and outer side panels 26. The inner side panels 25 reside inboard of the side walls 14, and the outer side panels 26 reside outside the side walls 14. These panels 25, 26 that are joined together as a frame via cross-members 27 and 28 that span the width of the chair 10. Those skilled in this art will appreciate that the frame 12 and backrest 24 can take many other forms that may be suitable for use with the present invention.

Referring again to FIGS. 1 and 2, a reclining mechanism 30 interconnects the frame 12 and the backrest 24. The reclining mechanism 30 includes two mounting brackets 32 that are fixed to the inner surfaces of the side wall 14, two angled pivot links 34, and an electrically-powered linear actuator 36. Each pivot link 34 is pivotally attached to the forward end of one of the mounting brackets 32 at a pivot 38 and extends upwardly and rearwardly therefrom to a fixed mounting location on the inner surface of a respective inner side panel of the backrest 24. An upper bridging member 35*a* extends between the upper ends of the pivot links 34, and a second lower bridging member 35*b* extends between the lower rear ends of the mounting brackets 32. The linear actuator 36, which includes a retractable rod 37, is pivotally interconnected with the lower bridging member 35*b* at a pivot 42 located at a flange 35*c*. The rod 37, which is in an extended condition in FIG. 2, is pivotally attached with the upper bridging member 35*a* at a pivot 40 located on a flange 35*d*. In this embodiment, the linear actuator 36 is configured to enable the rod 37 to cease movement in any position as it retracts; an exemplary linear actuator is the LA-31 actuator, available from Linak US Inc., Louisville, Ky., although other actuating units, such as hydraulic units, may also be employed. The linear actuator 36 is connected to a control mechanism (not shown), such as a push button, toggle switch, or the like, that energizes the linear actuator 36 to extend or retract the rod 37 as desired, and is also connected to an electrical power source (not shown) such as a battery or electrical outlet.

To move the chair 10 from the upright position of FIGS. 1 and 2 to the reclined position of FIG. 3) an occupant of the chair 10 energizes the linear actuator 36, which causes the rod 37 to retract relative to the body of the linear actuator 36. Retraction of the rod 37 rotates the backrest 24 and the pivot links 34 fixed thereto clockwise (from the vantage point of FIG. 2) about the pivot 38. This movement is controlled by the linear actuator 36, which rotates clockwise about the pivot 42. Although the occupant can cease movement of the backrest 24 in any desired partially reclined position, movement ceases entirely (i.e., the backrest 24 reaches the fully reclined position) when the retraction of the rod 37 into the cylinder 36 is complete (FIG. 3). In this position, the backrest 24 is more reclined relative to the floor than in the upright position; typically, the backrest 24 is inclined relative to the floor at an angle of between about 25 and 40 degrees.

Those skilled in this art will appreciate that other configurations for reclining mechanism may also be employed. For example, a reclining mechanism such as that disclosed in co-assigned U.S. patent application Ser. No. 11/156,187 that controls the reclining movement of the backrest and the seat may also be used. Other variations will also be recognized by those skilled in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A press-back style reclining seating unit, comprising:

a frame configured to rest on an underlying surface;

a seat fixed to the frame, the seat being generally horizontally disposed;

a generally upright backrest positioned above the rear portion of the seat; and a reclining mechanism that interconnects the frame and the backrest and controls the movement of the backrest relative to the frame between an upright position, in which the backrest is generally vertically disposed, and a fully reclined position, in which the backrest is more reclined relative to the underlying surface than in the upright position;

the reclining mechanism including an actuating unit that enables the backrest to move to and remain in any partially reclined position between the upright and fully reclined positions;

wherein the actuating unit is a linear actuator;

wherein the reclining mechanism includes two pivot links fixed to the backrest that pivot relative to the frame and to the linear actuator; and wherein a transversely-extending upper bridging member spans the two pivot links, a transversely-extending lower bridging member spans the frame, and the linear actuator is pivotally interconnected with each of the upper and lower bridging members.

2. The seating unit defined in claim 1, wherein each of the pivot links is an angled link.

3. The seating unit defined in claim 1, wherein the linear actuator includes a retractable rod, and wherein the rod retracts as the backrest moves from the upright position to the fully reclined position.

4. The seating unit defined in claim 1, wherein the chair is devoid of an extendable footrest.

5. A press-back style reclining seating unit, comprising:

a frame configured to rest on an underlying surface;

a seat fixed to the frame, the seat being generally horizontally disposed;

a generally upright backrest positioned above the rear portion of the seat; and a reclining mechanism that interconnects the frame and the backrest and controls the movement of the backrest relative to the frame between an upright position, in which the backrest is generally vertically disposed, and a fully reclined position, in which the backrest is more reclined relative to the underlying surface than in the upright position;

the reclining mechanism including an electrically-powered linear actuator that enables the backrest to move between the upright and fully reclined positions;

wherein the reclining mechanism includes two pivot links fixed to the backrest that pivot relative to the frame and to the linear actuator; and wherein a transversely-extending upper bridging member spans the two pivot links, a transversely-extending lower bridging member spans the frame, and the linear actuator is pivotally interconnected with each of the upper and lower bridging members.

6. The seating unit defined in claim 5, wherein each of the pivot links is an angled link.

7. The seating unit defined in claim 5, wherein the linear actuator includes a retractable rod, and wherein the rod retracts as the backrest moves from the upright position to the fully reclined position.

8. The seating unit defined in claim 5 wherein the chair is devoid of an extendable footrest.

9. A press-back style reclining seating unit, comprising:

a frame configured to rest on an underlying surface;

a seat fixed to the frame, the seat being generally horizontally disposed;

a generally upright backrest positioned above the rear portion of the seat; and a reclining mechanism that interconnects the frame and the backrest and controls the movement of the backrest relative to the frame between an upright position, in which the backrest is generally vertically disposed, and a fully reclined position, in which the backrest is more reclined relative to the underlying surface than in the upright position;

the reclining mechanism including:

a linear actuator that enables the backrest to move between the upright and fully reclined positions;

two pivot links fixed to the backrest that pivot relative to the frame and to the linear actuator;

a transversely-extending upper bridging member that spans the two pivot links; and a transversely-extending lower bridging member that spans the frame;

wherein the linear actuator is pivotally interconnected with each of the upper and lower bridging members.

10. The seating unit defined in claim 9, wherein each of the pivot links is an angled link.

11. The seating unit defined in claim 9 wherein the linear actuator includes a retractable rod, and wherein the rod retracts as the backrest moves from the upright position to the fully reclined position.

12. The seating unit defined in claim 9, wherein the chair is devoid of an extendable footrest.

* * * * *